United States Patent [19]

Teague

[11] 4,051,956

[45] Oct. 4, 1977

[54] HORIZONTAL PIPE HANDLING APPARATUS

[76] Inventor: J. T. Teague, P.O. Box 701, Elk City, Okla. 73644

[21] Appl. No.: 708,667

[22] Filed: July 26, 1976

[51] Int. Cl.[2] ..... E21B 19/00

[52] U.S. Cl. ..... 214/1 P; 214/1 PB; 214/2.5

[58] Field of Search ..... 214/1 P, 2.5, 1 PB; 175/85

[56] References Cited

U.S. PATENT DOCUMENTS

| | | | |
|---|---|---|---|
| 3,810,553 | 5/1974 | Crocker | 214/2.5 |
| 3,916,500 | 11/1975 | Brown | 214/2.5 X |

*Primary Examiner*—Robert J. Spar
*Assistant Examiner*—George F. Abraham
*Attorney, Agent, or Firm*—Robert K. Rhea

[57] ABSTRACT

A pair of open framework type pipe supporting stands are arranged in side by side spaced-apart relation transversely of a work path along which sections of pipe are moved. Each stand includes a top rail pivotally connected longitudinally with the respective ends of the stand and vertically movable at one end to form a horizontal or inclined plane for supporting a joint of pipe when horizontally disposed thereon transversely of the stands. Each stand further includes, at one end portion, a normally depending arm member vertically movable at one end portion between the plane formed by the top rails and an inclined plane slopping away from one end of the stand defined by a pair of skids connected at one end with the respective stand and extending at their other end portion toward a horizontally disposed pipe rack adjacent the surface of the earth for receiving a joint of pipe from the top rails and lowering and depositing the pipe joint on the pipe rack.

2 Claims, 5 Drawing Figures

10
12
14
16
18
20
22
24
26
30
32
36
38
44
46
48
50
52
54
56
58
60
62
64
65
66
68
72
74
76
78
80
82
84
85
86
87
88
90
92
94
96
98
100
102
104
5

HORIZONTAL PIPE HANDLING APPARATUS

BACKGROUND OF THE INVENTION

1. Field of the Invention

The present invention relates to handling pipe used in drilling or equipping oil wells, or the like, and more particularly to an apparatus for receiving pipe removed from a derrick or drilling rig and horizontally disposed longitudinally in a work path to be horizontally deposited on a pipe rack, or the like, laterally of the work path.

One of the problems associated with oil well operations is moving the pipe to an out-of-the-way racked position, usually adjacent the earth's surface, after the pipe has been removed from the well and rig and horizontally disposed so that the next joint of pipe may be laid down. Utilizing pipe pickup and laydown apparatus for depositing laid-down pipe on a rack at or near the surface of the earth is a time consuming and expensive operation.

The apparatus of this invention forms a portable pipe stand, elevated above the earth's surface, which will successively receive horizontally disposed joints of pipe when deposited thereon and transfer the pipe laterally to a pipe rack at a lower elevation.

2. Description of the Prior Art

Prior patents, such as the Beck U.S. Pat. Nos. 3,713,547 and 3,825,129, generally disclose apparatus for moving joints or stands of pipe from a vertically disposed position in a derrick to a horizontally disposed position laterally of the derrick, usually on the catwalk. These and other patents, for the most part, do not disclose apparatus for transferring the pipe from a horizontal laid-down position to a remote racked position laterally of the work path occupied by the pipe while being moved from the vertical to a horizontal position.

This invention accomplishes this by providing a pair of open framework type stands which successively receive joints of the pipe horizontally deposited thereon and transfers the pipe while horizontally disposed to a lower elevation laterally of the work path.

SUMMARY OF THE INVENTION

A pair of upstanding open framework type stands are arranged in generally parallel spaced-apart relation transversely of the work path employed for removing pipe from a derrick, or the like. Each of the stands include a pivotally connected top rail extending transversely of the work path and vertically movable at one end portion to form a horizontal or inclined plane for supporting a joint of pipe when horizontally disposed thereon transversely of the top rails. Each stand includes an arm member pivotally connected at one end to the stand and vertically movable at its other end portion from the plane of the top rails to an inclined plane extending downwardly and outwardly from the arm connected end of the stands as defined by a pair of skids connected with the stands. The purpose of the pivoting feature of the top rails and arms is to permit movement of the respective joint of pipe by gravity in a rolling action so that the pipe will move from a position supported by the rails to a position supported by the arms which in turn, when lowered, deposits the pipe on the inclined plane formed by the skids so that the pipe continues rolling by gravity from the skids to a horizontally supported position formed by the pipe rack at an elevation lower than the plane formed by the stand top rails.

The principal object of this invention is to provide a pipe handling apparatus for receiving horizontally disposed joints of pipe at one elevation and transferring such joints of pipe to a remote pipe racked position at a lower elevation.

DESCRIPTION OF THE PREFERRED EMBODIMENTS

Figures 1, 2:
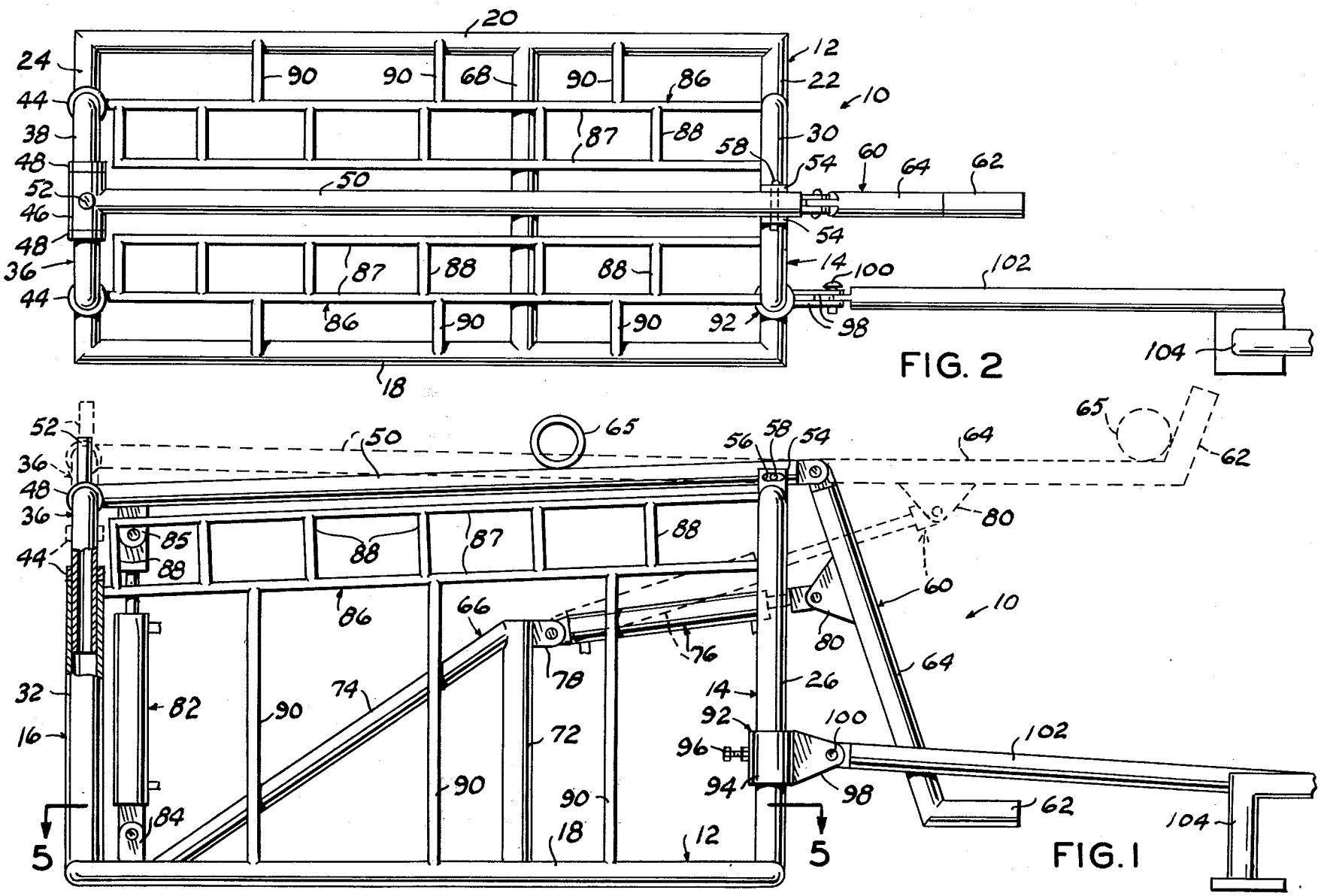
FIG. 1 is a side elevational view, partially in section, of one of the stands illustrating, by dotted lines, the vertical pivoting movement of its pipe supporting top rail and pipe lowering arm.
FIG. 2 is a top view of FIG. 1 with the pipe removed.

Like characters of reference designate like parts in those figures of the drawings in which they occur.

In the drawings:

The reference numeral 10 indicates one of the stands, as a whole, which is generally rectangular in overall configuration. The stand 10 is formed and operated in substantially identical pairs, as shown at 10 and 10' (FIG. 3), and in the interest of brevity, only the stand 10 will be described in detail.

The stand 10 is open framework in general appearance and in the example shown is formed principally from metallic rod and tubular material. The stand 10 includes a horizontal base frame 12 and upstanding forward and rearward frames 14 and 16, respectively. The base 12 is formed by a pair of longitudinally extending side rails 18 and 20 interconnected at their respective ends by front and rear cross members 22 and 24. The forward frame 14 comprises a pair of standards 26 and 28 connected at their depending ends in parallel spaced-apart relation to the forward base member 22 and rigidly interconnected at their upper ends transversely of the base by a top member 30.

Figure 4:
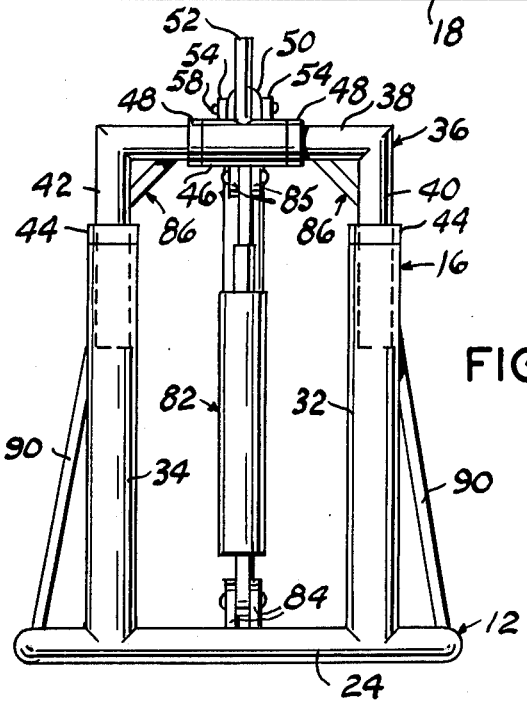
FIG. 4 is a rear end elevational view of one of the stands.

The rearward upright frame 16 comprises a pair of tubular members 32 and 34 rigidly secured at their depending ends to the base frame rear member 34 in similar parallel spaced relation. An inverted U-shaped yoke 36 (FIG. 4), having its bight portion 38 disposed horizontally, spans the spacing between the tubes 32 and 34 so that its depending legs 40 and 42 are coaxially aligned with and are reciprocable at their lower end portions within the upwardly open ends of the tubes 32 and 34. A ring stop 44, secured to each yoke leg 40 and 42 intermediate its ends, limits telescoping movement of the legs into the tubes 32 and 34 for the reasons presently apparent.

A sleeve 46 rotatively surrounds the medial portion of the yoke bight member 38 between a pair of collar-like stops 48, secured to the top member 38, and is rigidly connected to one end of a top rail 50 projecting at its other end beyond the forward frame top member 30 in overlying relation so that its longitudinal axis is inclined downwardly toward the rearward end of the stand when the yoke legs 40 and 42 are telescoped into the rearward frame tubes 32 and 34 and supported by the stops 44 for the purposes presently explained.

The sleeve 46 is provided with an upstanding stop 52 generally normal to the axis of the top rail 50 for the purposes presently explained. The forward end portion of the top rail 50 is disposed between a pair of upstanding ears 54, centrally secured to the forward frame top member 30, and each having an elongated horizontal slot 56 therein slidably receiving a pin 58 extending transversely through the top rail 50.

An elongated substantially L-shaped arm 60 is pivotally connected at one end to the forward end portion of the top rail 50 and normally depends therefrom. The foot portion 62 of the arm 60 is preferably disposed at an obtuse angle with respect to the longitudinal axis of its leg portion 64 to form a pipe stop for the purposes presently apparent.

The height of the forward and rearward frames 14 and 16 is chosen so that the cable supported carriages, not shown, underlying and supporting the respective end portions of a joint of pipe 65, may be released therefrom by gravity, when the pipe 65 is deposited on the top rails 50 and returned by the cable toward the rig and the next joint of pipe to be laid down.

A pressure cylinder support 66 is rigidly connected with the base frame 12. The pressure cylinder support 66 includes a T-shaped base portion having the bar 68 of the T-shape extending transversely between and rigidly connected with the base frame side members 18 and 20 and the stem portion 70 extending between and rigidly connected with the bar 68 and rearward end member 24 of the base frame. The cylinder support 66 further includes an upright standard 72 rigidly secured at its depending end to the cross bar 68 and connected at its upward end with an inclined brace 74 in turn connected to the stem member 70 adjacent its rearward limit.

A fluid pressure cylinder 76 extends between and is pivotally connected with a suitable ear 78 formed on the upper end portion of the standard 72 and a plate 80 secured to the upper end portion of the arm leg 64 for vertical pivoting movement of the arm 60 about a horizontal axis formed by its connection with the forward end of the top rail 50 for the purposes presently explained.

A similar vertically disposed fluid pressure cylinder 82 is pivotally connected at its respective ends with ears 84 and 85 cooperatively secured to the rearward end portion of the stem 70 and rearward end portion of the top rail 50, respectively, for vertical pivoting movement of the top rail 50 about the horizontal axis formed by the top rail pivot pin 58 for the reasons presently explained.

The pressure cylinders 76 and 82 are conventional and are connected with a source of fluid under pressure by conventional tubing and controls, not shown.

The upper end portions of the upright forward and rearward frames 14 and 16 are interconnected for rigidity by a pair of brace frames 86 comprising a pair of longitudinally extending rods 87 interconnected by a plurality of cross rods 88. A plurality of upward and inwardly inclined brace rods 90 interconnect the respective base frame side member with the lowermost brace frame rod 87.

A skid rail support 92 is connected with one of the forward frame standards preferably the outermost one when the stands 10 and 10' are arranged in side by side relation. The skid support 92 comprises a sleeve 94 vertically slidably surrounding the frame standard and provided with a set screw 96 to maintain it in a selected elevated position. A pair of forwardly projecting ears 98 are vertically secured edgewise to the sleeve 94 and provided with a transverse pin 100 for cooperative reception of one end of a skid 102 for supporting the latter with its longitudinal axis inclined downwardly and forwardly from the stand toward a conventional pipe rack, indicated at 104.

OPERATION

Figure 3:
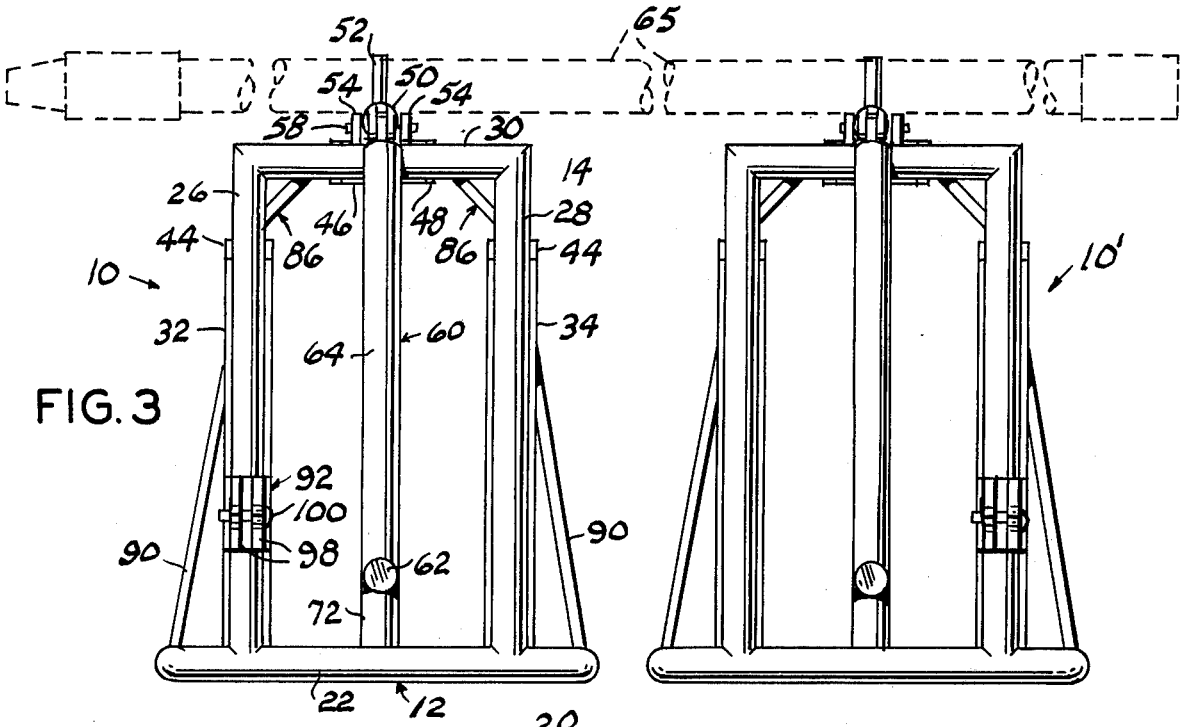
FIG. 3 is a front elevational view of the stand shown in FIG. 1 and its companion stand, illustrating by dotted lines, a joint of drill pipe, or the like, supported by the top rails.
Figure 5:
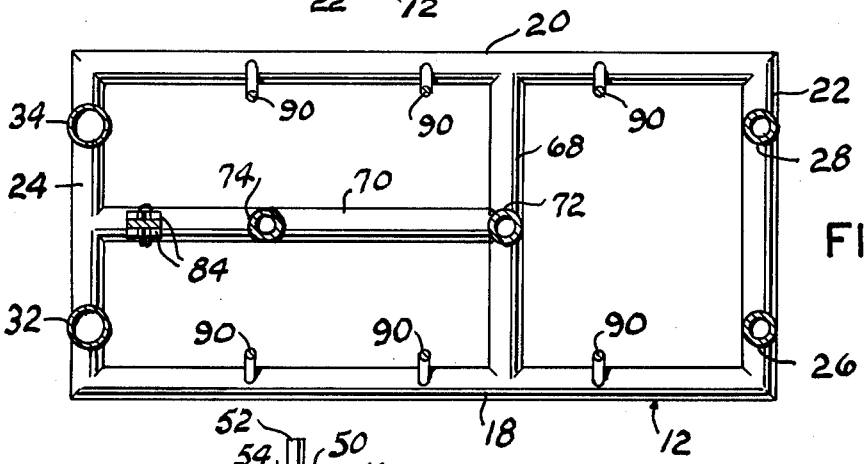
FIG. 5 is a horizontal cross sectional view to a reduced scale taken substantially along the line 5—5 of FIG. 1.

In operation the pair of stands 10 and 10' are arranged in generally parallel spaced-apart relation transversely of the work path, not shown, employed for laying down joints of pipe. The pipe is transferred from the well location by apparatus, not shown, which deposits one joint of the pipe 65 on the top rails 50 intermediate their ends so that the pipe is supported substantially as indicated by dotted lines (FIG. 3). The top rails 50 are initially inclined downwardly at their rearward ends so that when the joint of pipe 65 is disposed thereon and released the pipe joint rolls by gravity toward the stops 52 and a lateral out-of-the-way position to permit the pipe lay-down apparatus to be lifted and moved toward the derrick or well location to receive the succeeding joint of pipe. The pressure cylinders 82 are actuated for elevating the rearward end portions of the top rails 50 toward the dotted line position of FIG. 1 to form a plane inclined toward the forward end of the stands while simultaneously the pressure cylinders 76 are actuated to lift the arms 60 to the approximate position shown by dotted lines so that the joint of pipe 65 rolls toward and is supported by the arms 60, being retained thereon by the arm foot portions 62. The pressure cylinders 76 are then operated in the opposite direction so that the arms 60 are lowered toward the solid line position of FIG. 1 wherein when the pipe 65 reaches the inclined plane formed by the skids 102 the pipe rolls down this inclined plane and onto a horizontal pipe rack 104. Simultaneously with the lowering of the arms 60 the pressure cylinders 82 are operated in the opposite direction to again incline the top rails 50 toward the rearward end portion of the stands for receiving the next joint of pipe being laid down.

Obviously the pipe may be deposited, by the pipe lay-down apparatus, on the leg portion 64 of the arms when they are substantially horizontally disposed or inclined forwardly or rearwardly of the stands, if desired.

Obviously the invention is susceptible to changes or alterations without defeating its practicability. Therefore, I do not wish to be confined to the preferred embodiment shown in the drawings and described herein.

I claim:

1. Pipe handling apparatus, comprising:

a pair of upright generally rectangular stand means arranged in spaced-apart relation transversely of a work path along which sections of pipe are to be moved;

top rail means comprising an elongated top rail extending transversely of the work path and pivotally connected at one end portion with each said stand means for vertical pivoting movement of its other end portion about a horizontal axis, said top rail means cooperatively receiving and supporting a section of substantially horizontally disposed pipe when deposited thereon;

means including a top rail fluid pressure operated cylinder extending between and operatively connected at its respective ends with the respective said stand means and top rail opposite its said pivotal connection for inclining the longitudinal axis of said top rail means with respect to the horizontal to induce a gravity actuated rolling action transversely of the work path on a section of pipe when deposited thereon;

arm means comprising an elongated arm disposed transversely of the work path and pivotally connected at one end portion with the pivotally connected end portion of the respective said top rail for vertical pivoting movement of its other end portion toward and away from the surface of the earth and for receiving a section of pipe from said top rails when deposited thereon and lowering and releasing the section of pipe adjacent the surface of the earth;

a lateral normally upwardly directed stop secured to said other end portion of each said arm for normally maintaining a section of pipe on said arms; and, other fluid pressure operated cylinders interposed between and operatively connected with each said stand means and said arms, respectively.

2. The apparatus according to claim 1 and further including:

a vertical adjustable sleeve secured to a forward end portion of each said stand means; and, a skid rail supported at one end portion by each said sleeve.

* * * * *